US005492739A

United States Patent [19]

Thorne et al.

[11] Patent Number: 5,492,739

[45] Date of Patent: Feb. 20, 1996

[54] WINDOW SUPPORTED ORNAMENT APPARATUS

[76] Inventors: Leroy A. Thorne; Susan C. Potts, both of 40 Appleman Rd., Somerset, N.J. 08873

[21] Appl. No.: 259,551

[22] Filed: May 26, 1994

[51] Int. Cl.[6] ..... B44F 1/06

[52] U.S. Cl. ..... 428/38; 248/206.2; 428/7; 428/16

[58] Field of Search ..... 428/7, 38, 16; 248/206.2, 206.3, 206.4, 476, 309.3, 683, 908, 915

[56] References Cited

U.S. PATENT DOCUMENTS

| | | | |
|---|---|---|---|
| 1,606,853 | 11/1926 | Trisler | 428/31 X |
| 2,310,842 | 2/1943 | Davitt et al. | 428/24 X |
| 3,440,128 | 4/1969 | Kubilius | 428/11 |
| 3,635,783 | 1/1972 | Rimmler | 428/11 |
| 3,777,410 | 12/1973 | Robinson | 434/323 |
| 4,014,972 | 3/1977 | Rentz | 264/245 |
| 4,510,189 | 4/1985 | Girard | 428/19 |
| 4,908,244 | 3/1990 | Bullock | 428/18 X |
| 4,939,004 | 7/1990 | Fuss | 428/20 X |
| 5,232,644 | 8/1993 | Hammond et al. | 428/15 X |

*Primary Examiner*—Henry F. Epstein

[57] ABSTRACT

The apparatus is a flexible suction cup including a convex outer wall with a concave interior wall having a translucent design allowing illumination through the suction cup walls.

6 Claims, 3 Drawing Sheets

WINDOW SUPPORTED ORNAMENT APPARATUS

BACKGROUND OF THE INVENTION

1. Field of the Invention

The field of invention relates to ornament structure, and more particularly pertains to a new window supported ornament apparatus wherein the same is arranged for mounting to a transparent window pane to effect distortion and coloration of illumination directed through the window pane and ornament structure.

2. Description of the Prior Art

Ornament structure of various types are utilized throughout the prior art for enhanced ornamentation and enjoyment. Such structure is indicated in U.S. Pat. No. 4,939,004 to Fuss for positioning ornament structure relative to a Christmas tree. Further ornament constructions are set forth in the U.S. Pat. Nos. 3,440,128; 3,635,783; and 4,510,189.

Accordingly, it may be appreciated that there continues to be a need for a new window supported ornament apparatus as set forth by the instant invention which addresses both the problems of ease of use as well as effectiveness in construction to provide for enhanced enjoyment and decoration of structure within a dwelling and the like and in this respect, the present invention substantially fulfills this need.

SUMMARY OF THE INVENTION

In view of the disadvantages inherent in the known types of ornament apparatus now present in the prior art, the present invention provides a window supported ornament apparatus wherein the same is arranged to position an ornament structure relative to a window pane to effect the distortion of a light directed therethrough and the visual presentation of a decorator projection mounted to an interior surface of the suction cup structure. As such, the general purpose of the present invention, which will be described subsequently in greater detail, is to provide a new window supported ornament apparatus and method which has many of the advantages of the prior art listed heretofore and many novel features that result in a window supported ornament apparatus which is not anticipated, rendered obvious, suggested, or even implied by any of the prior art, either alone or in any combination thereof.

To attain this, the present invention provides a flexible suction cup including a convex outer wall with a concave interior wall having a translucent design allowing illumination through the suction cup walls.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new window supported ornament apparatus and method which has many of the advantages of the prior art listed heretofore and many novel features that result in a window supported ornament apparatus which is not anticipated, rendered obvious, suggested, or even implied by any of the prior art, either alone or in any combination thereof.

It is another object of the present invention to provide a new window supported ornament apparatus which may be easily and efficiently manufactured and marketed.

It is a further object of the present invention to provide a new window supported ornament apparatus which is of a durable and reliable construction.

An even further object of the present invention is to provide a new window supported ornament apparatus which is susceptible of a low cost of manufacture with regard to both materials and labor, and which accordingly is then susceptible of low prices of sale to the consuming public, thereby making such window supported ornament apparatus economically available to the buying public.

Still yet another object of the present invention is to provide a new window supported ornament apparatus which provides in the apparatuses and methods of the prior art some of the advantages thereof, while simultaneously overcoming some of the disadvantages normally associated therewith.

Even still yet another object of the present invention is to provide a new window supported ornament apparatus which includes a flexible suction cup having a convex outer wall with a concave interior wall having a translucent design allowing illumination through the suction cup walls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
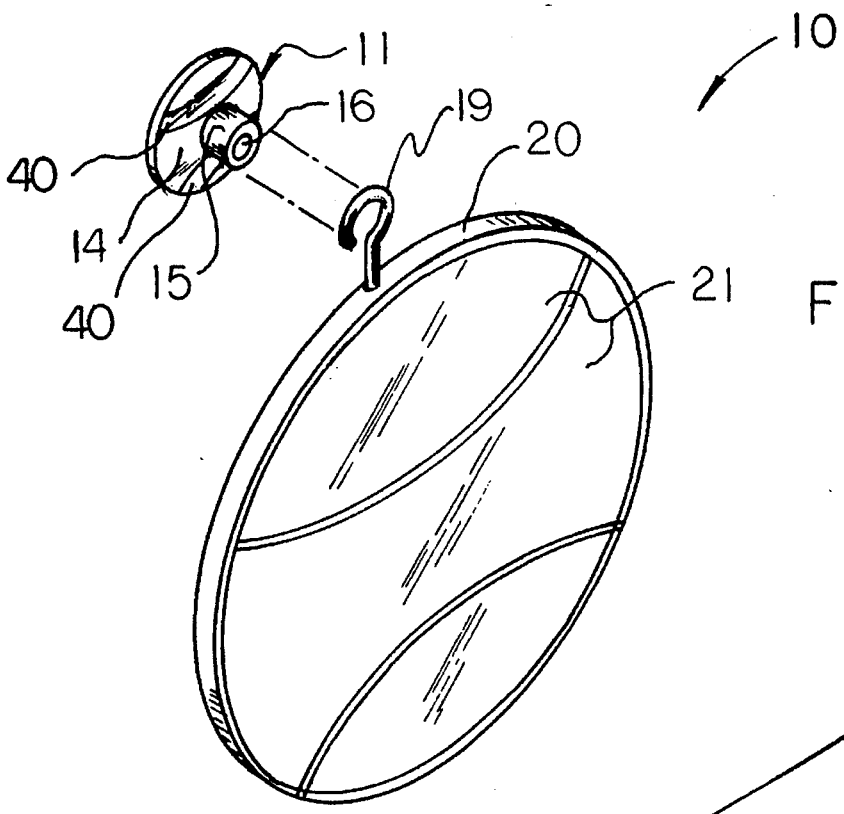
FIG. 1 is an isometric illustration of the instant invention.

With reference now to the drawings, and in particular to FIGS. 1 to 7 thereof, a new window supported ornament apparatus embodying the principles and concepts of the present invention and generally designated by the reference numeral 10 will be described.

Figure 2:
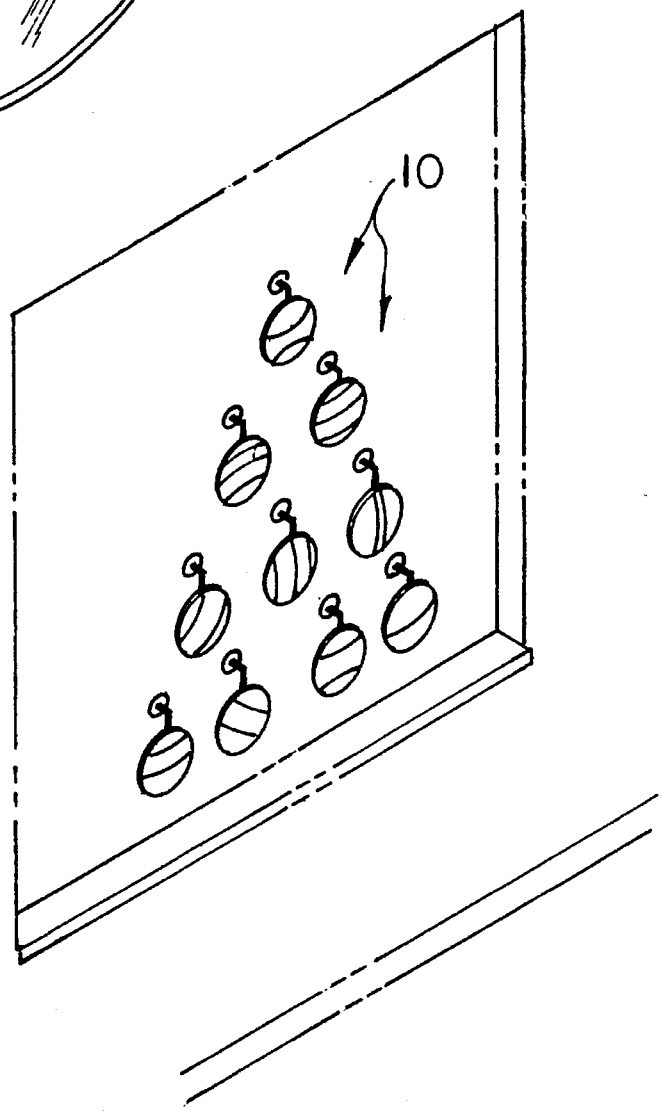
FIG. 2 is an isometric illustration of a matrix of various components of the invention mounted to a window pane structure.

More specifically, the window supported ornament apparatus 10 of the instant invention comprises a support suction cup 11 formed of a flexible material having a flexible semi-spherical cup wall 12 formed of a substantially translucent material, as illustrated in FIGS. 1 and 2. The wall 12 includes a concave interior surface 13 coextensive with a convex outer surface 14, with the wall having an outer thickness "OT" and an inner thickness "IT". Preferably, the inner thickness "IT" is substantially greater than the outer thickness "OT", thereby imparting a magnifying effect to the light transmitted through the wall 12. A tubular boss 15 formed of a resilient, deformable material is centrally and fixedly mounted to the convex outer surface 14, with the boss having a tubular boss bore 16 directed into the tubular boss 15. As indicated in FIGS. 1 and 2, a support hook 19 is provided and arranged to mount a rigid frame 20 to the hook 19 projecting downwardly from the hook in an orthogonal relationship such that the frame may be suspended from the boss 15 by an engagement of the hook to the boss. Alternatively, a suitably shaped projection may be positioned within the boss bore 16 to couple an object thereto. A plurality of contrastingly colored translucent frame panels 21 are mounted within the frame 20 to provide for enhanced light coloration directed through the structure 10.

Figures 3, 4, 5:
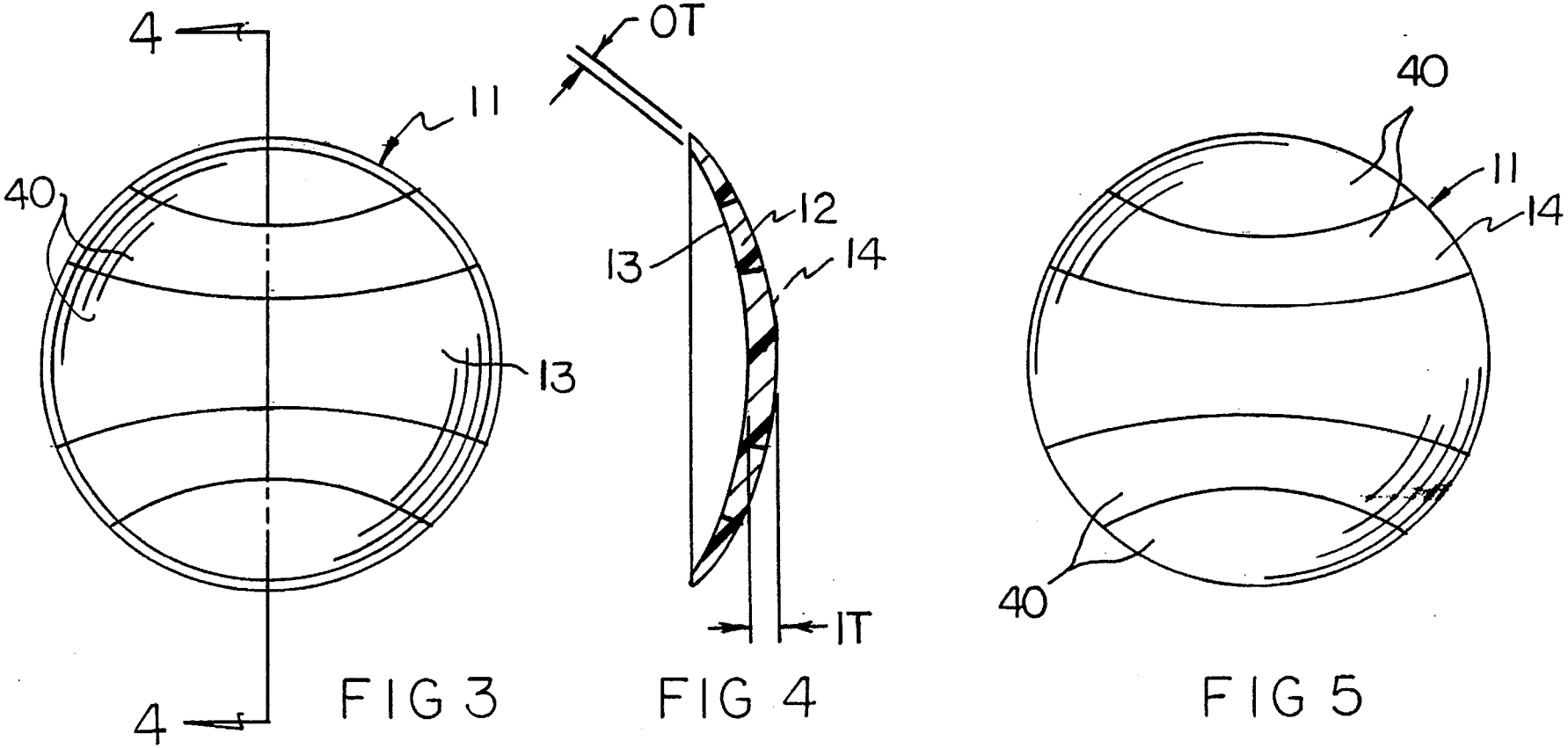
FIG. 3 is an orthographic view of the interior wall surface of the suction cup.
FIG. 4 is an orthographic view, taken along the lines 4—4 of FIG. 3 in the direction indicated by the arrows.
FIG. 5 is an orthographic view of the exterior surface of the suction cup member.
Figure 7:
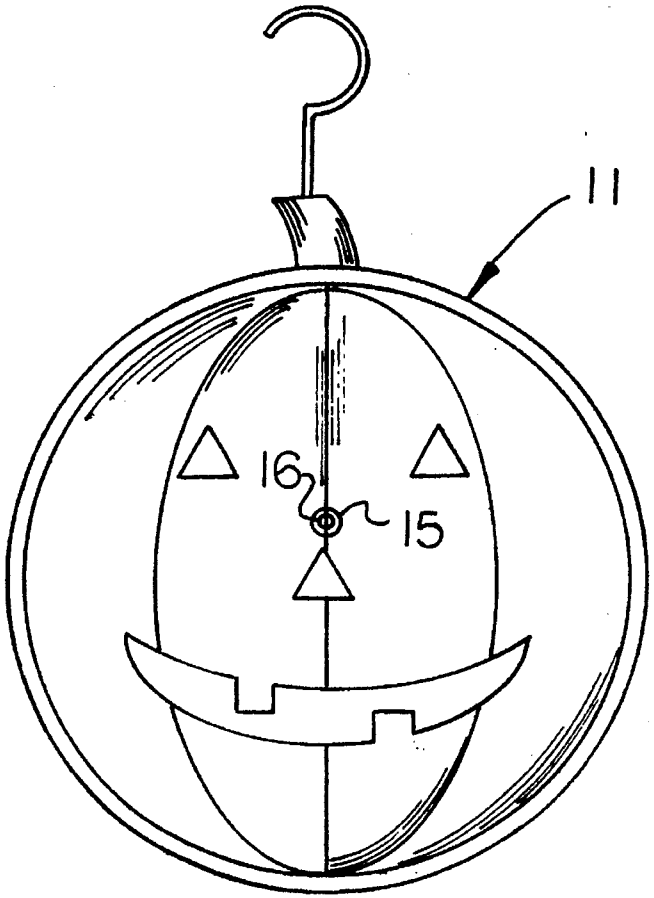
FIG. 7 is an orthographic view of an interior surface of a further suction cup structure as utilized by the invention.
Figure 6:
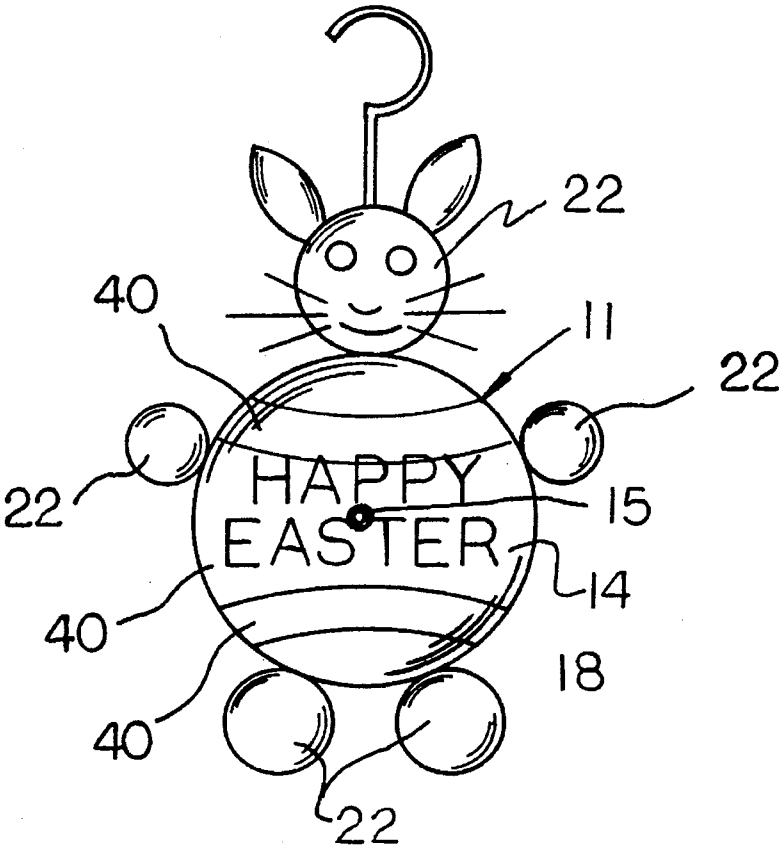
FIG. 6 is a diagrammatic illustration of the suction cup member including projections positioned thereabout.

The suction cup 11 is integrally formed of various translucent coloration cup panels 40 providing for distortion of light directed through the suction cup when mounted to a window, as indicated in FIGS. 1 and 2. The cup panels 40 are each integrally joined to one another to form the suction cup 11. Further, the cup panels 40, as shown in FIG. 4, are each shaped so as to define a substantially convex outer surface, a substantially concave inner surface, and an outer peripheral edge extending therebetween coupled to an adjacent cup panel such that the assembled support suction cup 11 defines the flexible semi-spherical cup wall 12 which can be deformed to create a vacuum between the suction cup and a non-porous support surface to vacuum adhere the suction cup relative thereto. The cup panels 40 may be configured to include Christmas balls, Valentine hearts, cupids, Easter eggs and the like and chosen from any of a variety of colorations such as indicated in FIG. 6. The FIG. 6 further illustrates the suction cup structure 11 having cup projections 22 directed exteriorly relative to the periphery 18 of the suction cup 11. The projections 22, as well as the message imparted within the suction cup wall 12, is enhanced upon light being directed through the suction cup when mounted as indicated in FIG. 2. FIG. 7 is indicative of the cup panels 40 configured in a jack-o-lantern shape relative to the Halloween holiday of the calendar year. In this manner, the assemblage of the suction cup structure 11 with the frame 20 mounted, in a manner as indicated in FIG. 2, provides for visual effect to enhance enjoyment and add to festivity relative to any calendar event.

The FIGS. 3–5 indicate the use of a further suction cup member 11*a*, having the concave interior wall 13 coextensive with the convex exterior wall 14. The suction cup 11*a* is formed of a translucent material having integrally formed contrastingly colored cup panels 40. The suction cup member 11*a* eliminates the tubular boss 15, thereby providing for elimination of any distortion of coloration therethrough. It should be noted that the suction cup member, in addition to the contrasting cup panels, may have the configuration of the structures indicated in the FIGS. 6 and 7, such as a jack-o-lantern shape or bunny shape, for enhanced visual effect.

As to the manner of usage and operation of the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A window supported ornament comprising:

a support suction cup, the suction cup formed of a translucent flexible material and including a flexible semi-spherical cup wall having contrastingly colored cup panels coupled to one another, the contrastingly colored cup panels each having a convex outer surface and a concave inner surface, with an outer peripheral edge extending between the convex outer surface and the concave inner surface, the cup panels being joined together at the outer peripheral edges thereof, said suction cup further having an interior concave surface, a convex outer surface, and an annular periphery, the convex outer surface including a tubular boss centrally and fixedly mounted to the convex outer surface, with the tubular boss having a boss bore directed therein.

2. An ornament as set forth in claim 1, and further including a rigid cylindrical frame having a hook member fixedly mounted thereto, the hook member being secured to the tubular boss, and a plurality of contrastingly colored translucent frame panels mounted within the frame to effect coloration and distortion of light directed therethrough.

3. An ornament as set forth in claim 2, wherein the annular periphery includes a plurality of projections extending beyond the annular periphery and fixedly mounted to the annular periphery.

4. A window supported ornament comprising:

a support suction cup, the suction cup formed of a translucent flexible material, the suction cup including a flexible semi-spherical cup wall having an interior concave surface coextensive with a convex exterior outer surface, the cup wall comprising a plurality of contrasting cup panels of various contrasting colorations coupled to one another, the contrastingly colored cup panels each having a convex outer surface and a concave inner surface, with an outer peripheral edge extending between the convex outer surface and the concave inner surface, the cup panels being joined together at the outer peripheral edges thereof, with the cup panels operating for permitting a directing of illumination through the suction cup and the panels.

5. A window supported ornament as set forth in claim 4, wherein said cup wall has an inner thickness and an outer thickness, with said inner thickness being substantially greater than said outer thickness such that light passing through said wall is magnified.

6. A window supported ornament as set forth in claim 5, wherein said suction cup includes opaque lines directed through the panels.

* * * * *